US006499857B1

(12) United States Patent
Lumley

(10) Patent No.: US 6,499,857 B1
(45) Date of Patent: Dec. 31, 2002

(54) LIGHTED CLOTHING ACCESSORIES

(76) Inventor: Adele Lumley, 175 Fernlea Crescent, Oakville, Ontario (CA), L6H 6B4

( * ) Notice: Subject to any disclaimer, the term of this patent is extended or adjusted under 35 U.S.C. 154(b) by 0 days.

(21) Appl. No.: 09/599,864

(22) Filed: Jun. 23, 2000

(51) Int. Cl.[7] ..... F21V 21/108

(52) U.S. Cl. ..... 362/154; 362/103; 362/104; 362/155; 362/156; 362/806; 362/183

(58) Field of Search ..... 362/103, 104, 362/154, 155, 156, 183, 234, 806; 2/905; 153/103; 36/136, 137

(56) References Cited

U.S. PATENT DOCUMENTS 1,977,995 A * 3/1934 Morali ..... 36/136
5,268,827 A * 12/1993 Granneman et al. ..... 362/156
5,444,605 A * 8/1995 Rivera ..... 362/156
5,567,037 A * 10/1996 Ferber ..... 362/104
5,690,412 A * 11/1997 Sheldon ..... 362/104
6,106,130 A * 8/2000 Harding ..... 362/108
6,132,059 A * 10/2000 Leibowitz ..... 362/156
6,158,872 A * 12/2000 Rodgers ..... 362/156

* cited by examiner

*Primary Examiner*—Sandra O'Shea
*Assistant Examiner*—Anabel Ton

(57) ABSTRACT

A clothing accessory article such as a handbag or a high heeled shoe, etc. has an exterior surface provided with a plurality of lights dispersed among gem like members which are illuminated by the lights. The article includes a switch for on/off control of the lights and that switch is disguised as a decorative finishing member on the article.

10 Claims, 3 Drawing Sheets

LIGHTED CLOTHING ACCESSORIES

FIELD OF THE INVENTION

The present invention relates to a clothing accessory and in particular a lighted clothing accessory.

BACKGROUND OF THE INVENTION

It is known in the clothing industry to provide clothing accessories such as handbags and shoes with lights to illuminate the accessory. In the case of the handbags, the lighting is found interiorly of the handbag for functional rather than decorative purposes.

In the case of the shoes, the lighting is typically provided interiorly of the heel of the shoe which must then either be made transparent or provided with transparent windows to allow the light to escape from the heel. This necessitates sophisticated and expensive modifications to the shoe without adding to the decorative appearance of the shoe itself.

SUMMARY OF THE PRESENT INVENTION

The present invention relates to an article of clothing accessory in which an exterior surface of the article is decorated with lighting. More particularly, the exterior surface of the article is provided not only with a plurality of lights but it is also provided with gem like members dispersed among and illuminated by the lights.

According to an aspect of the invention, the article includes a switch for on/off control of the lights and consistent with maintaining the pleasing aesthetic appearance of the article the switch is disguised as a decorative finishing member on the article.

BRIEF DESCRIPTION OF THE DRAWINGS

The above as well as other advantages and features of the present invention will be described in greater detail according to the preferred embodiments of the present invention in which.

DETAILED DESCRIPTION ACCORDING TO THE PREFERRED EMBODIMENTS OF THE PRESENT INVENTION IN WHICH

Figure 1:
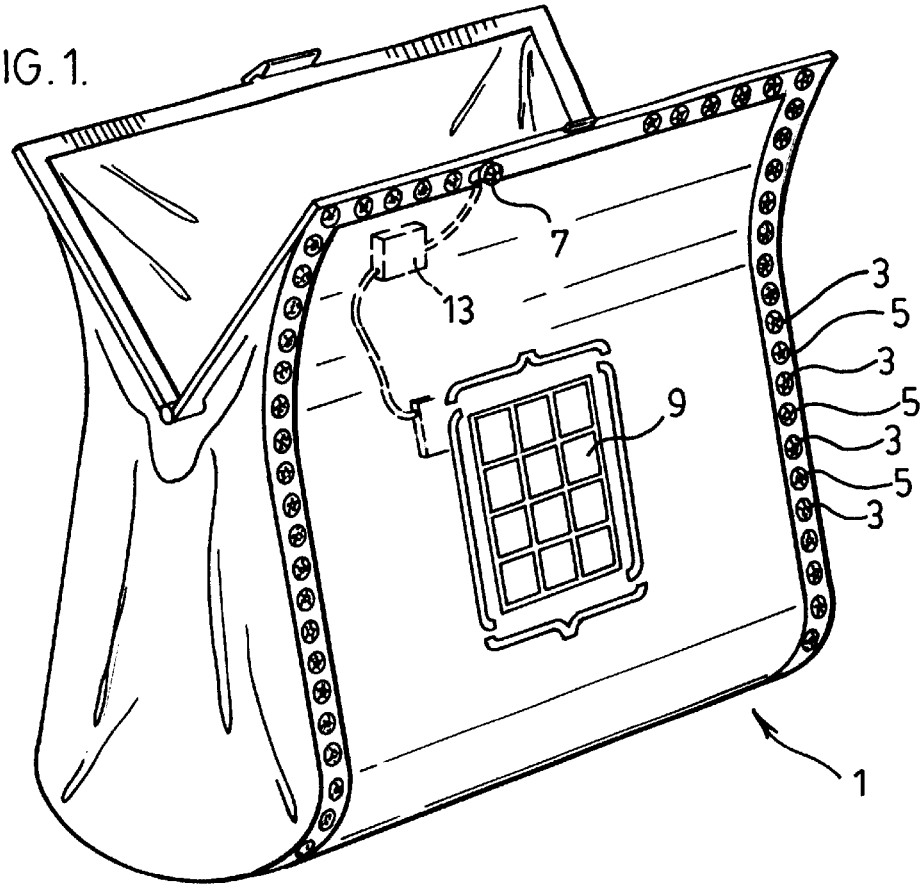
FIG. 1 is a perspective view of a women's handbag having a lighted exterior surface in accordance with a preferred embodiment of the present invention.
Figure 3:
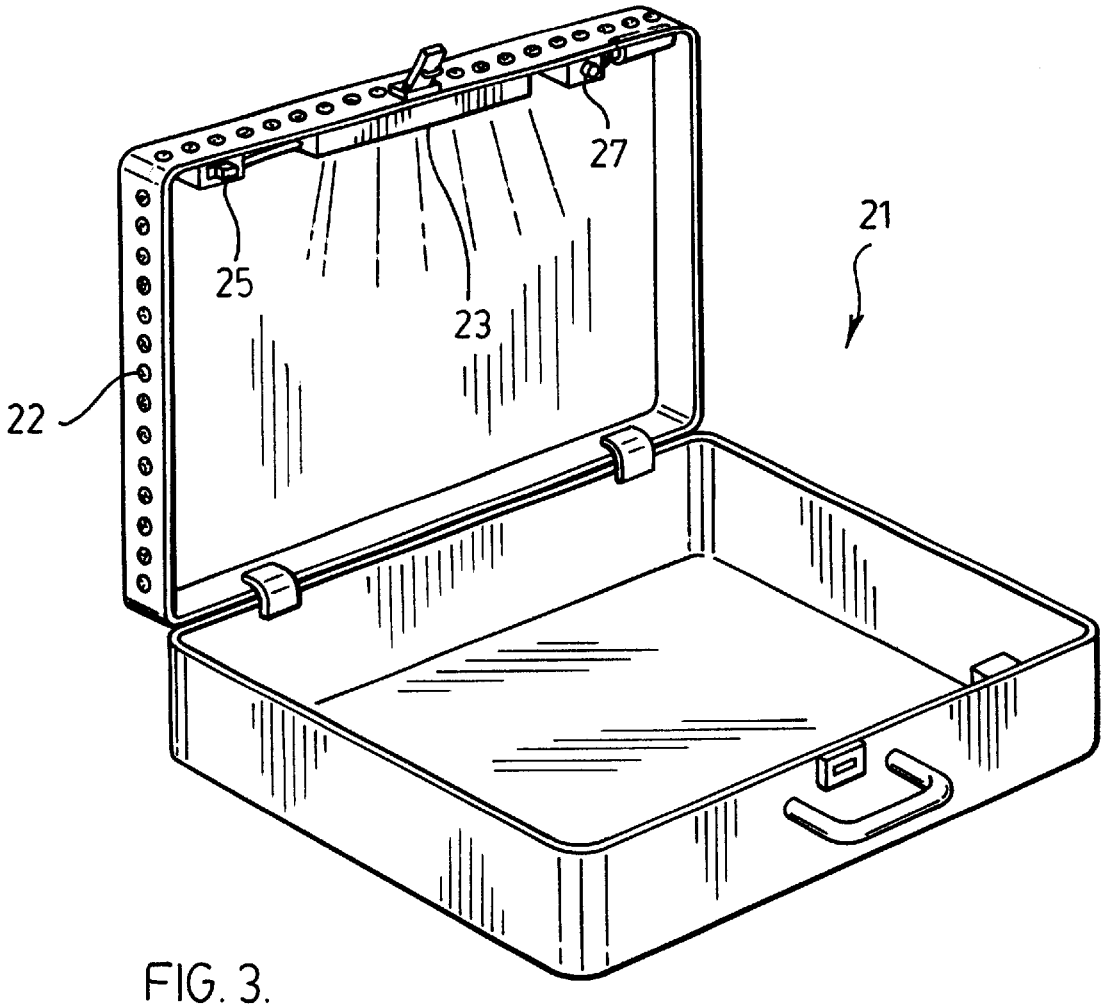
FIG. 3 is a perspective view of a briefcase according to still a further preferred embodiment of the present invention.
Figure 4:
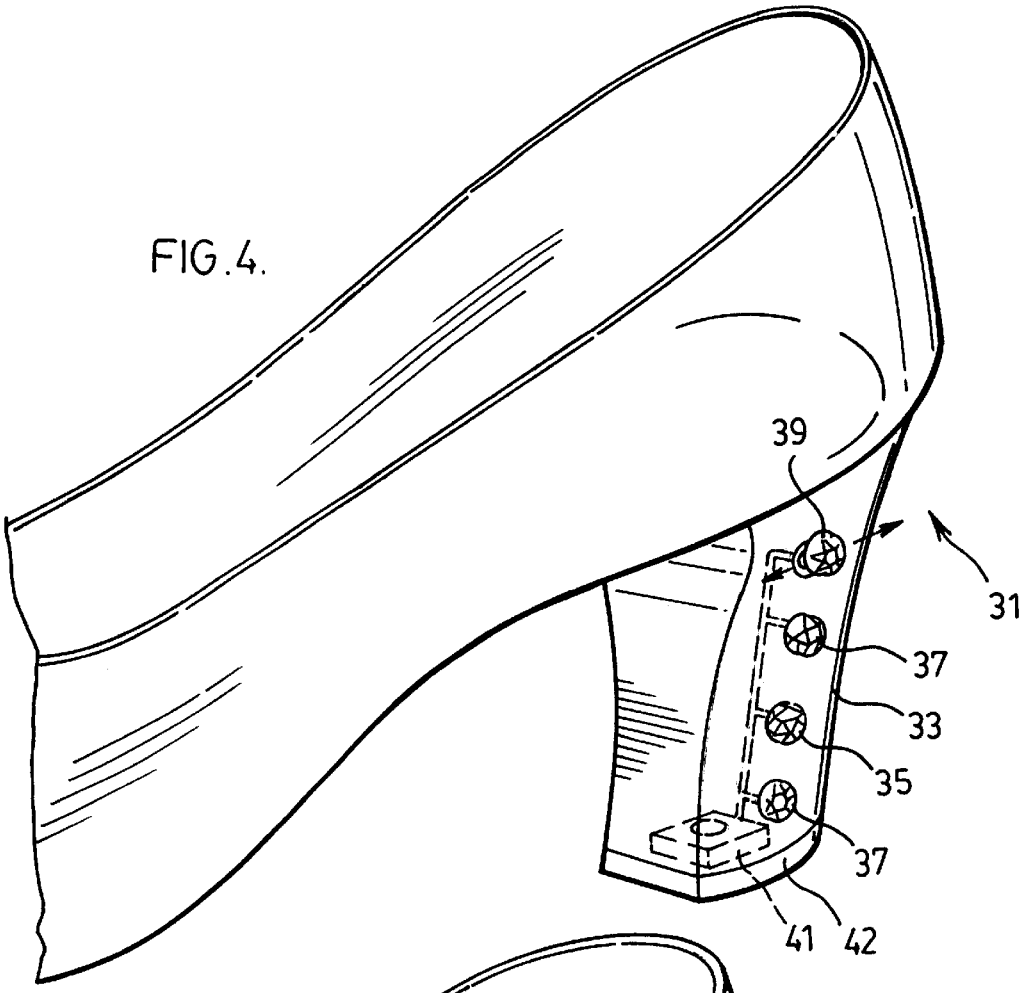
FIGS. 4 and 5 are enlarged perspective views of the heel region of a women's shoe made in accordance with still a further preferred embodiment of the present invention.
Figure 5:
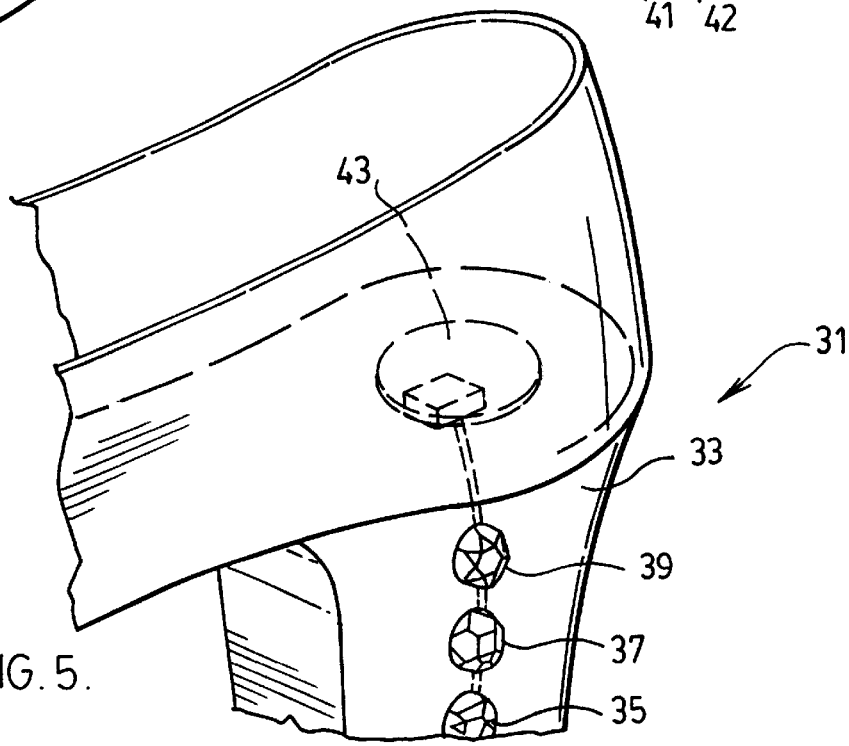

FIG. 1 shows a women's handbag generally indicated at 1 with an exterior decorated surface. This handbag is only one of many different clothing accessory articles embodying the principals of the present invention. By way of example, FIG. 3 shows a briefcase generally indicated at 21 and FIGS. 4 and 5 show a women's high heeled shoe generally indicated at 31 also decorated in accordance with the present invention.

Returning to FIG. 1, handbag 1 includes a series of small lights 3 on the exterior surface of the handbag. These lights are strategically placed for maximizing the handbags appearance.

Lights 3 are dispersed among a plurality of small gem like members 5 also on the exterior surface of the handbag. In the embodiment shown, the gem like members comprise rhinestones which are placed side by side in an alternating fashion with the lights 3.

The lights are wired to a power supply which may be a normal AC battery or in the embodiment shown in FIG. 1 comprises a energy storage cell 13. This cell 13 receives energy from a solar panel 9 also provided on the exterior surface of the bag and designed to add to its aesthetic appeal.

In the embodiment shown in FIG. 1, the actual on/off switch for the lights comprises one of the lights on the exterior surface of the bag. However, because its appearance is identical to all of the other lights, it is effectively disguised as a decorative member on the handbag.

Light 7 pushes between an on and an off position for the light circuit. The movement of light 7 is only very slight which further adds to the disguising of the switch. This movement can either be in a side to side direction or light 7 can be spring loaded to move in and out for turning the circuit on and off.

Figure 2:
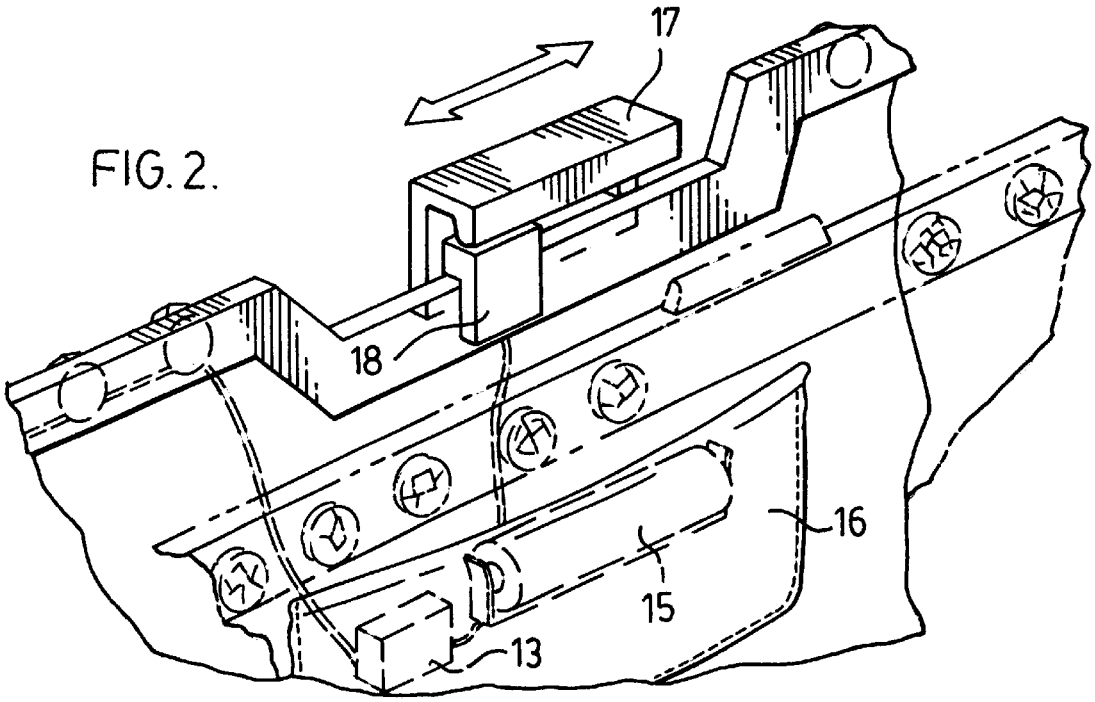
FIG. 2 is an enlarged perspective view of the clasp region of a handbag according to still a further preferred embodiment of the present invention.

It is to be understood that rather than using one of the lights as a switch, the switch could just as easily be one of the rhinestones or it could be another decorative member on the exterior surface of the bag. For example, FIG. 2 shows an arrangement in which the bag clasp 17 has a two fold function. Firstly, it operates in a normal manner for closing the bag and secondly, through a slight. sideways shifting of clasp 17 it becomes the switch for operating the external lighting on the bag.

It is to be further noted in FIG. 2 that the lighting circuit in addition to including the small storage cell 13 also includes a standard AC battery 15 as a backup energy source for the lighting system. Both cell 13 and AC battery 15 are hidden in a small pouch 16 internally of the bag where they are easily accessible for replacement and/or repair purposes.

As will be appreciated from reviewing FIG. 1, lights 3 not only perform the function of externally lighting the bag but in addition, illuminate the rhinestones 5 among which the lights are dispersed. This provides an extremely appealing overall lighting effect for the bag.

As an additional feature, the lighting circuit includes a small timer 18 which passes and then interrupts power to the lights even when the switch is turned on. This produces an intermittent on/off cycling of the lights on the bag surface.

FIG. 3 shows an additional feature of the present invention in which a briefcase 21 again having external lighting as indicated at 22 further includes an internal light 23 illuminating the interior contents of the briefcase. The lighting is controlled by an on/off switch 25 which can be set to an automatic or a manual position. When in the automatic position, the lights come on as soon as the briefcase is opened. The briefcase further includes an automatic shut off 27 which shuts down the electrical circuit when the briefcase is closed.

When switch 25 is set to the manual position, the lights are physically turned on or off by the user when the briefcase is opened. The automatic shut off continues to work when the switch is in the manual position to ensure that the interior lights are not inadvertently left on.

It is to be understood that the above concept of interior lighting is also applicable to the handbag shown in FIG. 1 of the drawings. This interior lighting is very helpful in illuminating the contents of the handbag in otherwise darkened conditions.

FIGS. 4 and 5 of the drawings show a women's fashion shoe generally indicated at 31. This fashion shoe includes a high heel 33 once again decorated with exterior lighting. This light comprises a first light 35 and a second lighting 39. These lights are dispersed among gem like members 37 which are illuminated by the lights. Again, the gem like members are preferably rhinestones which give off a certain brilliance when they are illuminated by the lights.

In the embodiment shown, light 39 which is positioned near the upper end of the heel of the shoe acts as the switch for the lighting circuit. However, it's switching function is not evident in that light 39 has the identical appearance to light 35. The only difference between the two lights is that light 39 is movable over a very short distance for turning on and off the lighting circuit.

It is to be noted that the relatively high positioning of switch light 39 places it away from the ground where it might otherwise be contaminated by ground dirt or moisture.

The heel of the shoe further includes a small cellular battery 41 replaceably fitted into the heel. To this end, the bottom cap 42 of the heel opens and closes which allows easy access to the battery for repair or replacement purposes.

It should also be noted that the lights and the rhinestones are located on the exterior surface rather than interiorly of the heel of the shoe. Therefore, with the exception of these components the shoe heel has an otherwise normal elegant appearance.

In accordance with a preferred embodiment of the present invention, a pressure sensor 43 is provided directly above the heel interiorly of the shoe. This pressure sensor operates with the main switch 39 in the on position to turn the lights on and off with each step taken in the shoe, i.e. the pressure sensor will turn the lights on when subject to weight of the person and will turn the lights off when the weight is released from the pressure sensor.

When switch 39 is in the off position, pressure sensor 41 has no effect and the lights will remain in the off condition.

As will be appreciated, the s hoe shown in FIGS. 4 and 5 is particularly appealing when the user of the shoe is for example dancing under low light conditions causing the shoe to flash on and off in an attractive, elegant and highly visible manner.

Although various preferred embodiments of the present invention have been described in detail, it will be appreciated by those skilled in the art that variations may be made without departing from the spirit of the invention or the scope of the appended claims.

The embodiments of the invention in which an exclusive property or privilege is claimed are defined as follows:

1. An article of clothing accessory having an exterior surface provided with a plurality of lights dispersed among gem like members which are illuminated by said lights, said article comprising a hand bag and said gem like members comprising rhinestones, said lights and said rhinestones being placed, in alternating sequence, side by side with one another.

2. An article of clothing accessory as claimed in claim 1, wherein one of said lights comprises a switch for turning said lights on and off.

3. An article of clothing accessory as claimed in claim 1, wherein one of said rhinestones comprises a switch for turning said lights on and off.

4. An article of clothing accessory as claimed in claim 1, including a clasp for said handbag, said clasp also comprising a switch for turning said lights on and off.

5. An article of clothing accessory as claimed in claim 1, further including internal lighting within said handbag.

6. An article of clothing accessory having an exterior surface provided with a plurality of lights dispersed among gem like members which are illuminated by said lights, said article of clothing comprising a shoe having a high heel and said gem like members comprising rhinestones, said lights and said rhinestones being located on said heel of said shoe and one of said lights or said rhinestones comprising a switch for turning said lights on and off.

7. An article of clothing accessory as claimed in claim 1, including a timer which is operated by a main switch and which causes intermittent on/off operation of said lights when said switch is turned on.

8. An article of clothing accessory as claimed in claim 1, including a decorative solar panel on said handbag and a storage battery for storing energy collected by said solar panel.

9. An article of clothing accessory as claimed in claim 6, wherein said switch is located in an upper end region of said heel.

10. An article of clothing accessory as claimed in claim 9, including a secondary control member which is turned on and off by said switch, said secondary control member comprising a pressure sensor which turns said lights on and off when said switch is turned on, said pressure sensor being located internally of said shoe above said heel.

* * * * *